US008680445B2

(12) United States Patent
Schulte

(10) Patent No.: US 8,680,445 B2
(45) Date of Patent: Mar. 25, 2014

(54) FIELD CALIBRATION OF MICROWAVE OVEN

(75) Inventor: Robert A. Schulte, Williamsburg, IA (US)

(73) Assignee: ACP, Inc., Cedar Rapids, IA (US)

( * ) Notice: Subject to any disclaimer, the term of this patent is extended or adjusted under 35 U.S.C. 154(b) by 746 days.

(21) Appl. No.: 12/784,224

(22) Filed: May 20, 2010

(65) Prior Publication Data

US 2010/0294755 A1 Nov. 25, 2010

Related U.S. Application Data

(60) Provisional application No. 61/179,947, filed on May 20, 2009.

(51) Int. Cl.
*H05B 6/68* (2006.01)

(52) U.S. Cl.
USPC ..... 219/702; 219/412; 219/497; 219/696

(58) Field of Classification Search
USPC ..... 219/696, 702, 412, 497
See application file for complete search history.

(56) References Cited

U.S. PATENT DOCUMENTS 4,580,025 A * 4/1986 Carlson et al. ..... 219/708
4,733,158 A 3/1988 Marchione et al.
4,761,539 A * 8/1988 Carmean ..... 219/497
5,212,360 A 5/1993 Carlson
5,253,564 A * 10/1993 Rosenbrock et al. ..... 99/328
5,546,331 A 8/1996 Mathews
5,653,906 A 8/1997 Fowler et al.
7,081,601 B2 7/2006 Boyer et al.
7,554,061 B2 6/2009 Ruther et al.
2005/0274711 A1* 12/2005 Boyer ..... 219/494

FOREIGN PATENT DOCUMENTS

WO WO 2009107130 A1 * 9/2009

* cited by examiner

*Primary Examiner* — Tom Thomas
*Assistant Examiner* — Christopher M Roland
(74) *Attorney, Agent, or Firm* — Diederiks & Whitelaw, PLC

(57) ABSTRACT

A voltage calibration routine for an oven, particularly a microwave oven, enables a field technician to enter a voltage calibration mode to display on the oven a pre-established default voltage to which the oven is calibrated. The technician then measures the actual line voltage applied to the oven and, if different than the default voltage displayed, inputs the actual line voltage into the microwave oven control, such as via a keypad. Thereafter, an offset value is calculated to correct the voltage measurement, allowing for a correct tap selection when the microwave oven is running. An additional function is available to check the oven voltage reading upon accessing a voltage reading mode wherein the oven measures and displays the line voltage which is compared to a volt meter reading such that a simple comparison can be made, while avoiding certain steps associated with the voltage calibration mode.

20 Claims, 3 Drawing Sheets

FIELD CALIBRATION OF MICROWAVE OVEN

CROSS-REFERENCE TO RELATED APPLICATIONS

The present application claims the benefit of U.S. Provisional Patent Application Ser. No. 61/179,947 entitled "Field Calibration of Microwave Oven" filed May 20, 2009.

BACKGROUND OF THE INVENTION

1. Field of the Invention

The present invention pertains to the art of cooking and, more particularly, to field calibrating a microwave oven voltage switch point.

2. Discussion of the Prior Art

As widely known in the art, a microwave employs a magnetron to generate microwaves which are directed into an oven cavity for cooking purposes. The magnetron operates based on a high voltage received from a transformer that is connected to a line voltage. Microwave controls that are configured to run on two different line voltages are typically designed to automatically measure the line voltage in order to determine a particular tap associated with the power supply transformer which should be used. This automatic arrangement therefore sets the appropriate tap before a cooking cycle is initiated. By way of example, a microwave oven may be supplied with a nominal line voltage of 208 or 240 VAC, with this voltage being stepped up by the transformer in order to power the magnetron. Preferably, the supply power would be maintained substantially constant. However, the actual line voltage can vary over a tolerance range which may be in the order of +/−10-15%.

With this in mind, proper operation of the microwave oven requires that the appropriate tap be selected. Unfortunately, the voltage measurement taken by the microwave oven is limited in accuracy, mainly based on component tolerances and operational variances over time. Certainly, the voltage measurement can be tested and set within a couple of volts when it leaves a manufacturing factory, but the measurement can drift over time. If the oven is placed in use after being shipped from the factory and there is no way for a service technician to correct the calibration once it is drifted, unnecessary failures can occur.

SUMMARY OF THE INVENTION

In general, the invention is directed to a voltage calibration routine for a microwave oven that can be used by a field technician to recalibrate a voltage measurement of the oven. Once in a voltage calibration mode, a display on the microwave oven shows the pre-established default voltage to which the oven is calibrated. The technician then measures the actual line voltage applied to the oven and, if different than the default value displayed, inputs the actual value into the microwave oven control, such as via a keypad. Thereafter, an offset value is calculated to correct the voltage measurement, allowing for a correct tap selection when the microwave oven is running.

More specifically, in accordance with one preferred embodiment, a voltage calibration routine is incorporated into oven software and the service technician can access the routine to correct the calibration of the voltage measurement by the oven. In a preferred embodiment, the microwave oven is put into the calibration mode by pressing and holding a predetermined button on the keypad for a predetermined period of time, e.g., five seconds. Once the control is in the voltage calibration mode, a display on the front of the microwave oven indicates the default voltage for the oven. With the use of an accurate volt meter, the technician measures the actual line voltage applied to the oven and enters this voltage through a front panel keypad into the control. If the actual line voltage corresponds to the default voltage, the technician can simply accept the default value being displayed. If a new value is inputted, the default value is replaced by the new value. Thereafter, another control step is performed, such as by pressing a start button on the keypad, wherein an offset value is calculated to correct the voltage measurement to correspond to the new input value. Once the oven now has the correct line voltage, operation of the oven will be carried out with the oven control selecting the correct tap when running a cook cycle.

In further accordance with the invention, an additional function is available to access through the keypad in order to check the oven voltage reading. That is, another button or combination of buttons on the keypad are used to access a voltage reading mode which, when entered, the display will show the line voltage measured by the oven. This line voltage measurement can then be used to compare to a volt meter reading of the incoming line voltage such that a simple comparison can be made without actually performing the additional steps associated with the voltage calibration mode.

Additional objects, features and advantages of the present invention will become more readily apparent from the following detailed description of a preferred embodiment when taken in conjunction with the drawings wherein like reference numerals refer to corresponding parts.

DETAILED DESCRIPTION OF THE PREFERRED EMBODIMENT

Figure 1:
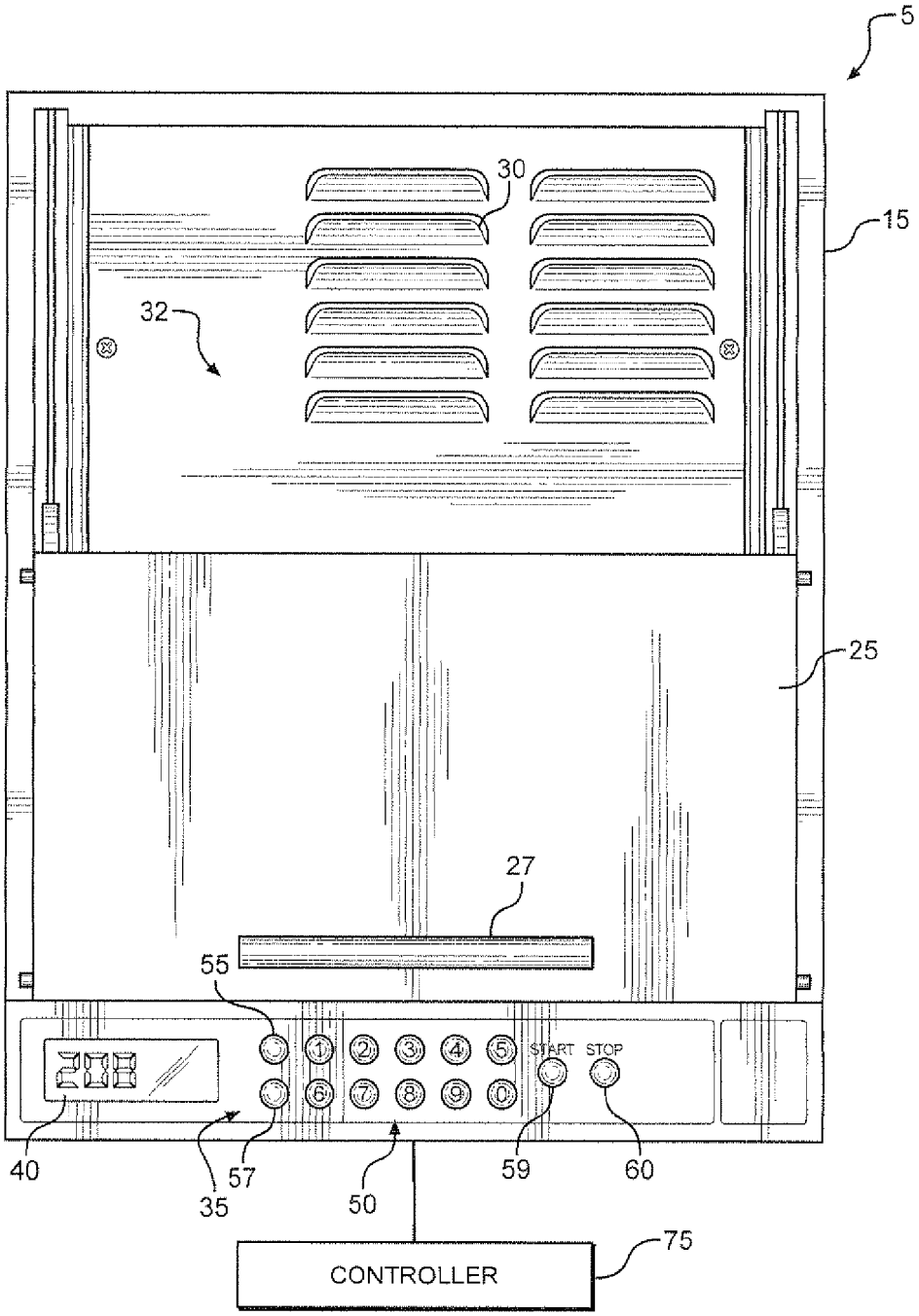
FIG. 1 is a front elevational view of a microwave oven incorporating the field calibration control system of the invention.
Figure 2:
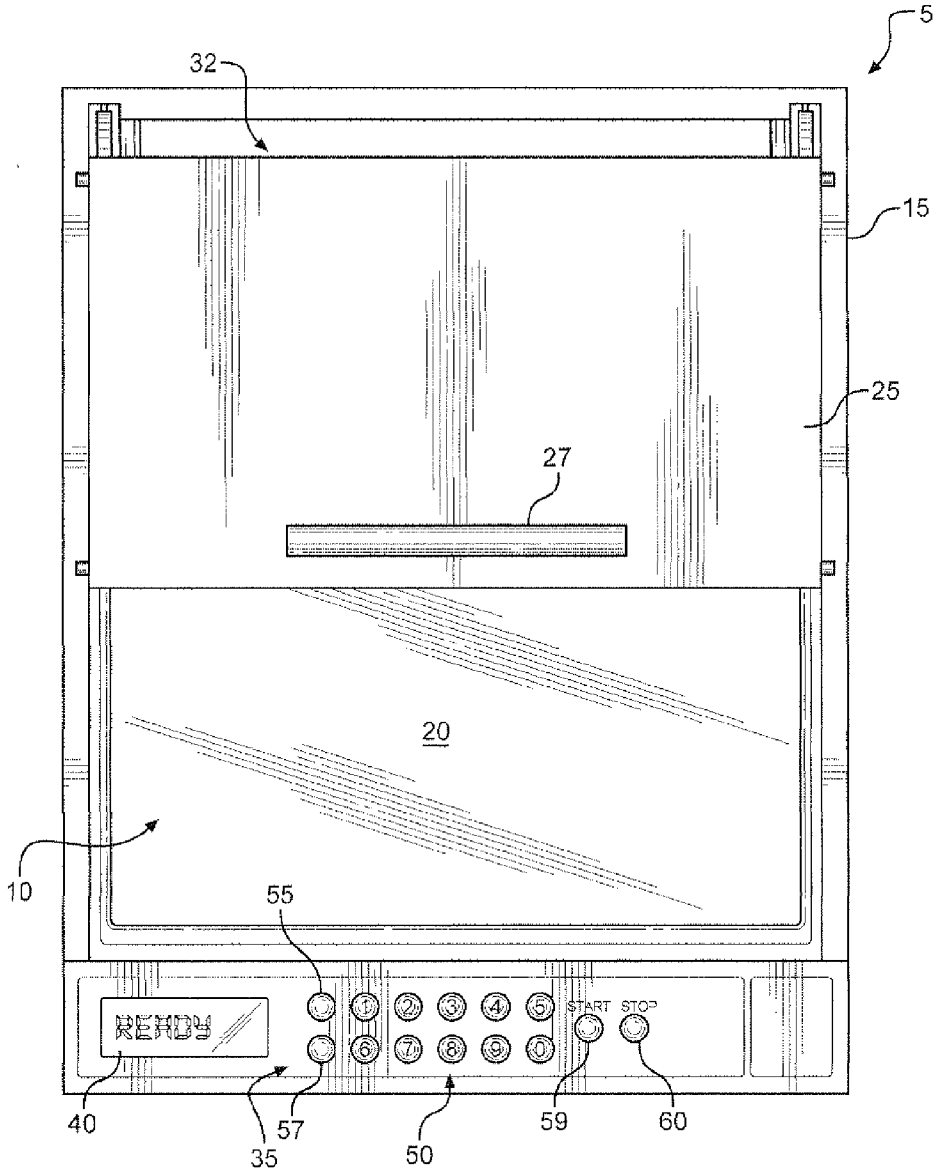
FIG. 2 is a front elevational view of the microwave oven of FIG. 1 with a door thereof shown in an open position.

With initial reference to FIGS. 1 and 2, a microwave oven constructed in accordance with the present invention is generally indicated at 5. As shown, microwave oven 5 includes an outer cabinet 15 within which is formed a lower oven or process cavity 10 defined, at least in part, by a rear wall 20 arranged behind a door 25 having a handle 27. Door 25 is movable between an open position exposing cavity 20 as shown in FIG. 2 and a closed position as shown in FIG. 1 wherein venting louvers 30 in an upper component housing portion 32 are exposed. In the embodiment shown, arranged below cavity 10 on a front portion of microwave oven 5 is a control panel 35 including a multi-segment display 40, a numeric keypad section 50, an entry button 55, a power level button 57, a start button 59 and a stop button 60. In the embodiment shown, cavity 10 is in the order of 13 inches wide, 8 inches deep and 6 inches in height. However, at this point, it should be noted that the particular construction, size and control panel configuration shown in these figures are only presented for exemplary purposes and can vary greatly in accordance with the overall invention. Although not shown, microwave oven 5 includes one or more magnetrons for generating microwaves which are directed into oven cavity 10 during a cooking operation. With this basic arrangement in mind, the present invention is particularly directed to field calibrating microwave oven 5 as will be discussed more fully below.

For operational purposes, microwave oven 5 is adapted to be plugged into an outlet which, at least in the United States, is generally a 208 or 240 VAC. When microwave oven 5 is initially manufactured, a controller 75 (see FIG. 1) is accurately preprogrammed for voltage measurement. However, over time, the voltage measurement operation can exhibit drift. To counter this tendency, the invention provides for recalibrating microwave oven 5 in the field by a technician.

Figure 3:
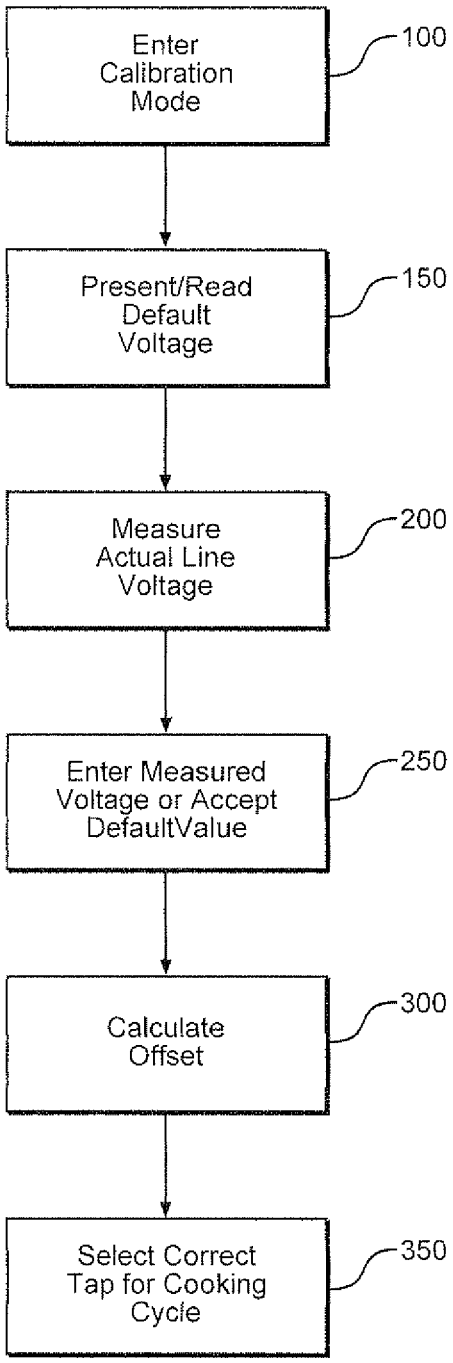
FIG. 3 is a flow diagram illustrating a voltage calibration routine in accordance with the invention.

With reference to FIG. 3, a preferred method of performing the recalibration will be detailed. In an initial step 100, the microwave oven is put into the calibration mode by pressing and holding one or more predetermined buttons on control panel 35 for a predetermined period of time, e.g., five seconds. Once the control is in the voltage calibration mode, display 40 on the front of microwave oven 5 indicates the default voltage for oven 5. In step 150, the default voltage is read, with this default voltage being indicated to be 208 VAC in FIG. 1. In step 200, with the use of an accurate volt meter, the technician measures the actual line voltage applied to oven 5. In step 250, the technician can enter this voltage through keypad 50 into controller 75. However, if the actual line voltage corresponds to the default voltage, the technician can simply accept the default value being displayed, such as by just pushing enter button 55. If a new value is inputted, the default value is replaced by the new value. In step 300, another control step is performed, such as by pressing start button 59 on control panel 35, wherein an offset value is calculated to correct the voltage measurement to correspond to the new input value. Once the oven now has the correct line voltage, operation of the oven will be carried out with the oven control selecting the correct tap when running a cook cycle as indicated by step 350.

In further accordance with the invention, an additional function is available to access through control panel 35 in order to simply check the oven voltage reading. That is, another button or combination of buttons on control panel 35 are used to access a voltage reading mode which, when entered, will cause display 40 to show the line voltage measured by oven 5. This line voltage measurement can then be used to compare to a volt meter reading of the incoming line voltage such that a simple comparison can be made without actually performing the additional steps associated with the overall voltage calibration mode.

Although described with reference to a preferred embodiment of the invention, it should be readily understood that various changes and/or modifications can be made to the invention without departing from the spirit thereof. In general, the invention is only intended to be limited by the scope of the following claims.

I claim:

1. A method of field calibrating an operating voltage for an oven comprising:
- entering a voltage calibration mode for the oven;
- measuring an actual line voltage applied to the oven;
- inputting the actual line voltage into the oven;
- calculating an offset value based on both a default voltage, as read by the oven, and the actual line voltage to establish a corrected operating voltage for the oven; and
- operating the oven based on the corrected operating voltage.

2. The method of claim 1, further comprising:
- displaying the default voltage to which the oven is calibrated; and
- inputting the actual line voltage into the oven if the actual line voltage is different than the default voltage.

3. The method of claim 2, further comprising: displaying the default voltage on a display screen provided on the oven.

4. The method of claim 3, further comprising: inputting the actual line voltage through a keypad provided on the oven.

5. The method of claim 1, further comprising: entering the voltage calibration mode through a keypad provided on the oven.

6. The method of claim 5, further comprising: entering the voltage calibration mode by pressing and holding one or more predetermined buttons on the keypad for a pre-established period of time.

7. The method of claim 1, further comprising: operating the oven based on the corrected operating voltage by allowing for a correct tap selection when the oven is running.

8. The method of claim 1, further comprising: upon entering the calibration mode, automatically displaying the default voltage on a frontal portion of the oven.

9. The method of claim 8, further comprising: accepting the default voltage as the corrected operating voltage if the actual line voltage corresponds to the default voltage.

10. The method of claim 1, wherein the offset value is calculated only upon selecting a start button on a keypad of the oven.

11. The method of claim 1, further comprising:
- entering a voltage reading mode;
- measuring a line voltage by the oven;
- displaying the line voltage measured by the oven; and
- comparing the actual line voltage with the line voltage measured by the oven.

12. A method of field calibrating an operating voltage for an oven comprising:
- entering a voltage calibration mode for the oven;
- displaying a default voltage, as read by the oven;
- measuring an actual line voltage applied to the oven;
- inputting the actual line voltage into the oven;
- calculating an offset value based on both the default voltage and the actual line voltage to establish a corrected operating voltage for the oven;
- setting the default voltage to be the corrected operating voltage; and
- operating the oven based on the default voltage.

13. The method of claim 12, further comprising: inputting the actual line voltage into the oven only if the actual line voltage is different than the default voltage.

14. The method of claim 12, wherein the default voltage is displayed on a display screen provided on the oven.

15. The method of claim 12, further comprising: entering the voltage calibration mode by pressing and holding one or more predetermined buttons on a keypad for a pre-established period of time.

16. The method of claim 12, further comprising: accepting the default voltage as the corrected operating voltage if the actual line voltage corresponds to the default voltage.

17. The method of claim 12, wherein the offset value is calculated only upon selecting a start button on a keypad of the oven.

18. The method of claim 12, further comprising:
- entering a voltage reading mode;
- measuring a line voltage by the oven;
- displaying the line voltage measured by the oven; and
- comparing the actual line voltage with the line voltage measured by the oven.

19. The method of claim 12, further comprising: operating the oven based on the default voltage read by the oven prior to entering the voltage calibration mode.

20. A method of operating an oven comprising:

reading, with the oven, a default voltage;

operating the oven based on the default voltage;

entering a voltage calibration mode for the oven;

measuring an actual line voltage applied to the oven;

inputting the actual line voltage into the oven;

calculating an offset value based on both the default voltage and the actual line voltage to establish a corrected operating voltage for the oven; and operating the oven based on the corrected operating voltage.

* * * * *